United States Patent [19]

Skalleberg

[11] 4,371,308

[45] Feb. 1, 1983

[54] ARRANGEMENT IN A CABLE WINDING MACHINE

[75] Inventor: Öystein Skalleberg, Järfälla, Sweden

[73] Assignee: Skaltek AB, Kungsangen, Sweden

[21] Appl. No.: 198,141

[22] PCT Filed: Feb. 1, 1980

[86] PCT No.: PCT/SE80/00031

§ 371 Date: Oct. 9, 1980

§ 102(e) Date: Oct. 9, 1980

[87] PCT Pub. No.: WO80/01682

PCT Pub. Date: Aug. 21, 1980

[30] Foreign Application Priority Data

Feb. 9, 1979 [SE] Sweden ..... 7901173

[51] Int. Cl.[3] ..... B66F 9/00

[52] U.S. Cl. ..... 414/416; 414/459; 414/911

[58] Field of Search ..... 414/391, 392, 399, 416, 414/458, 459, 540–542, 908, 910, 911; 242/54 R, 58.6

[56] References Cited

U.S. PATENT DOCUMENTS 3,695,532 10/1972 Lindstaedt ..... 242/58.6 X 4,098,468 7/1978 Skalleberg ..... 242/54 R

*Primary Examiner*—Robert G. Sheridan

*Attorney, Agent, or Firm*—Fleit & Jacobson

[57] ABSTRACT

A cable winding machine movable on a bedding (2) and having two vertical support members (1) interconnected by an extensible cross bar (14). The support members carry spindles (3) for supporting a cable reel (4). Each of the spindles is displaceable along its support member (1). The cable reel (4) rests on a pallet (7), except during a cable reeling or unreeling process. Lifting members (9) project at the lower part of at least one of the support members (1) for carrying the pallet (7) at the same time as the cable reel (4) is carried by the spindles (3). The lifting members (9) are resiliently suspended and assume a lower position when they are loaded by a pallet (7) with a reel (4) and assume an upper position when they are loaded with only a pallet (7). In the upper position of the lifting members (9), the pallet (7) is lifted up from the bedding (2) in order not to obstruct the movement of the cable winding machine on the bedding (2).

4 Claims, 3 Drawing Figures

ARRANGEMENT IN A CABLE WINDING MACHINE

BACKGROUND OF THE INVENTION

1. Field of the Invention

The present invention relates to an arrangement in a cable winding machine movable on a bedding and of the type that comprises two vertical support members interconnected by means of an extensible cross bar, said support members being adapted to carry a cable reel between themselves by means of two spindles each displaceable along one of said support members, said cable reel resting on a pallet except during a cable reeling or unreeling process, and lifting means projecting at the lower part of at least one of the support members for carrying the pallet at the same time as the cable reel is carried by the spindles.

2. Description of the Prior Art

A cable winding machine of the above type is known from U.S. Pat. No. 4,098,468.

Large amounts are lost each year through damages to cable reels as well as to cable stored thereon which damages arise during handling and storing.

In order to reduce the number of such damages it has been proposed that cable reels, empty as well as full, should be stored on individual pallets preferably constructed from iron bars which pallets preferably are provided with wheels in order to facilitate their transportation on a plane bedding.

In cable winding machines of the above kind a problem arises with such pallets during the process of reeling or unreeling the cable. After the pallet with a cable reel has been brought in between the support members of the cable winding machine and the cable reel has been lifted up by means of the spindles, the pallet has to be removed from the cable winding machine in order not to obstruct its movement during the cable reeling or unreeling process. After this process has been completed, the pallet anew has to be rolled in between the support members in order to carry the cable reel. A lot of manual work is required to accomplish this which has to be considered as a drawback in a modern production plant.

SUMMARY OF THE INVENTION

The object of the present invention is, therefore, to provide an arrangement by means of which it will be possible to eliminate the above described extra work with the removal of the empty pallet when the cable reel is suspended in the winding machine.

According to the invention this object is attained in that the lifting means are resiliently suspended and adapted to assume a lower position when they are loaded with a pallet with a reel and an upper position when they are loaded with only a pallet, said pallet being lifted up from the bedding in said upper position of the lifting means.

BRIEF DESCRIPTION OF THE DRAWING

The invention will be described more in detail below with reference to the attached drawing, in which.

Figure 1:
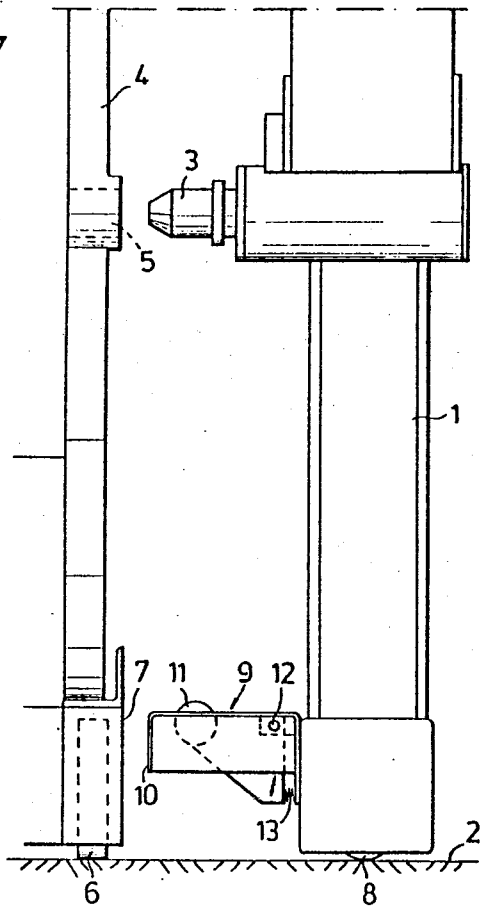
FIG. 1 shows one side of an arrangement according to the invention out of engagement with a pallet which carries a cable drum.
Figure 3:
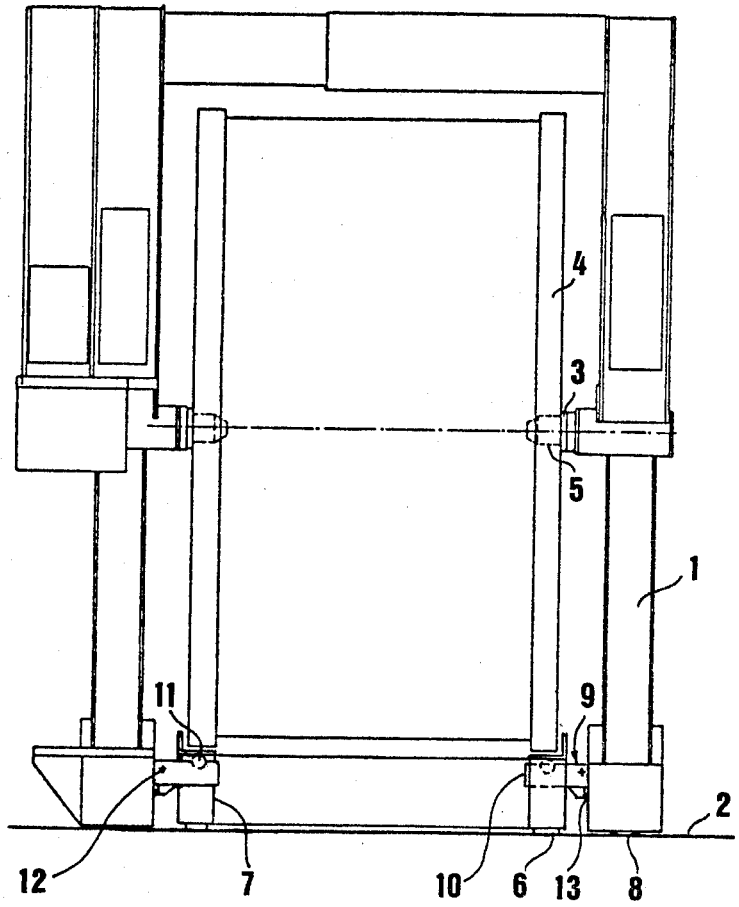
FIG. 3 shows both sides of the arrangement of FIG. 2.

1 in FIG. 1 designates one of the two vertical support members of a cable winding machine which is movable on a bedding 2. The support members 1 are interconnected by a telescopic crossbar (shown in FIG. 3). The support members carry spindles 3 facing each other, which can be raised and lowered in order to lift a cable reel 4 having a central hole 5. Except during the process of reeling or unreeling a cable, the cable reel 4 rests on a pallet 7 preferably provided with wheels 6. The pallet does not constitute part of the invention and is, therefore, not shown in detail.

According to the shown embodiment, the cable winding machine is of the kind that via wheels 8 can move on the bedding 2 during the cable reeling or unreeling process. In order to avoid unnecessary work with the removal of the empty pallet from the cable winding machine during the cable reeling or unreeling process, the cable winding machine is according to the present invention provided with an arrangement by means of which the empty pallet is brought with the cable winding machine lifted up from the bedding during the movement of the cable winding machine. Except during the cable reeling or unreeling process itself, the cable winding machine can move in order to transport a cable reel with a cable reeled thereon from one place to another.

The arrangement according to the invention comprises at the lower end of the support members 1 two projecting lifting means 9 facing each other and being resiliently suspended which lifting means are adapted to cooperate with recesses, protrusions or the like on the pallet 7. The lifting means 9 may comprise a bracket 10 mounted at the lower end of the support members 1, in which a cam disc 11 is pivoted on a pin 12. Moreover, the cam disc 11 is spring-biased by means of a compression spring 13.

When the support member 1 is moved to the left in order to introduce the spindle 3 into the central hole 5 of the cable reel 4 the lifting means 9 are introduced into the recesses (not shown) in the pallet 7. Under influence of the weight of the cable reel, the cam disc 11 will be pressed downwards so that its upper edge will be flush with the upper surface of the bracket 10.

Figure 2:
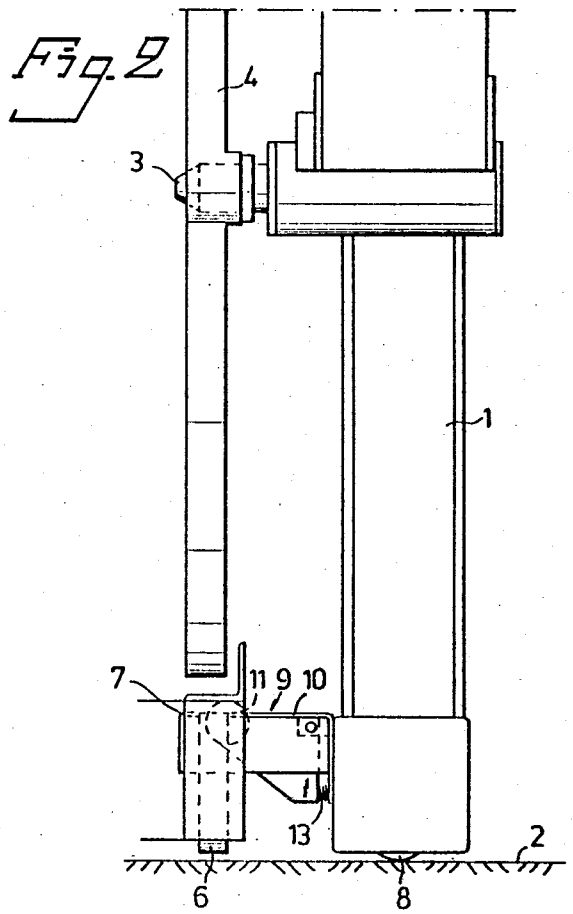
FIG. 2 shows one side of the arrangement according to the invention in engagement with the pallet.

Then, when the cable reel 4 is lifted by means of the spindles 3 introduced into the central hole 5, the cable reel 4 will be lifted up from the angle bar of the pallet 7 as apparent from FIG. 2. In order for the empty pallet 7 to be lifted up from the bedding 2 in order not to obstruct the movement of the cable winding machine on said bedding, the compression spring 13 is so dimensioned that it, via the cam disc 11, lifts the empty pallet 7 from the bedding 2 so that the wheels 6 of the pallet 7 do not touch the bedding 2.

By means of means not shown the empty pallet 7 can be locked to the lifting means 9 so that it does not change position during the movement of the cable winding machine but so that the cable reel 4 after a completed cable reeling or unreeling process again can be lowered onto the pallet 7 for further transportation.

Of course, the lifting means 9 do not have to be designed in the manner shown on the drawing. Thus, instead of the cam disc 11 a spring-biased ball can be present.

Moreover, it should be apparent that the arrangement according to the invention may be further varied and modified by anyone skilled in the art within the scope of the attached claims.

I claim:

1. An apparatus for use with a cable winding machine for supporting a cable reel and a pallet for the cable reel, said machine comprising:

two vertical support members;

an extensible cross bar interconnecting said support members so that the support members are relatively movable with respect to each other between a support position and a release position;

a spindle supported by and vertically displaceable along each of said support members, the spindles cooperating with each other to carry a cable reel when the support members are in the support position; and lifting means for carrying a pallet, said lifting means being carried by a lower portion of one of said support members and projecting toward the other of said support members, said lifting means being resiliently suspended from said one of said support members and being movable between a lower position when loaded with a pallet and reel and an upper position when loaded with a pallet only so that the pallet is lifted when the reel is removed from the pallet by vertical displacement of said spindles.

2. An apparatus according to claim 1, wherein said support members are supported by wheels for horizontal movement.

3. An apparatus according to claim 1, wherein each of said support members carries lifting means.

4. An apparatus according to claim 1, wherein said lifting means comprises a bracket carried by said one of said support members, a pin supported by said bracket, a cam disc pivotally mounted on said pin, and a spring for urging said cam disc towards the upper position of said lifting means, said cam disc being engageable with the pallet to lift the pallet when the cable reel is removed therefrom.

* * * * *